US008057365B1

(12) United States Patent
McClarnon

(10) Patent No.: US 8,057,365 B1
(45) Date of Patent: Nov. 15, 2011

(54) METHOD AND MEANS FOR RECORDING AND DISPLAYING MARTIAL ARTS ACHIEVEMENTS

(75) Inventor: Tracy A. McClarnon, Bellevue, NE (US)

(73) Assignee: Martial Arts International LLC, Bellevue, NE (US)

( * ) Notice: Subject to any disclaimer, the term of this patent is extended or adjusted under 35 U.S.C. 154(b) by 1876 days.

(21) Appl. No.: 11/146,995

(22) Filed: Jun. 7, 2005

(51) Int. Cl.
*A63B 21/00* (2006.01)

(52) U.S. Cl. ..... 482/83; 482/124

(58) Field of Classification Search ..... 482/105, 482/124, 74, 148; 600/300; 116/222–225; 224/197, 271; 473/35
See application file for complete search history.

(56) References Cited

U.S. PATENT DOCUMENTS

| | | | | |
|---|---|---|---|---|
| 3,122,851 | A * | 3/1964 | Sepe | 116/223 |
| 3,278,185 | A * | 10/1966 | Bidopia et al. | 482/124 |
| 3,716,016 | A * | 2/1973 | Aylesworth et al. | 116/222 |
| 4,158,342 | A * | 6/1979 | Scruggs | 116/225 |
| 4,557,215 | A * | 12/1985 | Petersson | 116/222 |
| 4,846,459 | A * | 7/1989 | Vivian | 482/74 |
| 6,322,482 | B1 * | 11/2001 | Kim | 482/124 |
| 6,478,736 | B1 * | 11/2002 | Mault | 600/300 |
| 6,520,863 | B2 * | 2/2003 | Porper | 473/35 |
| 6,824,028 | B2 * | 11/2004 | Mutai et al. | 224/271 |

* cited by examiner

*Primary Examiner* — Jerome W Donnelly
(74) *Attorney, Agent, or Firm* — Bryan P. Stanley; Kutak Rock LLP

(57) ABSTRACT

A method for recording and displaying achievements on a martial arts belt is provided with a base member, which is removably or permanently coupled with the martial arts belt. A plurality of achievement indicators are provided to releasably engage the base member and display indicia relating to particular achievements. Indicia may be disposed along the base member and read using an electronic scanner that is coupled with a computer to track individual student attendance. Software may be provided for storing and organizing data relating to the achievements and attendance of each student.

17 Claims, 9 Drawing Sheets

METHOD AND MEANS FOR RECORDING AND DISPLAYING MARTIAL ARTS ACHIEVEMENTS

BACKGROUND OF THE INVENTION

1. Field of the Invention

The present invention relates to a method and means for recording and displaying martial arts achievements, and more particularly to a method that employs the use of a clip that is coupled with an individual's belt and receives one or more removable achievement indicators, which are prominently displayed on the clip, that assist in the tracking and recording of the individual's achievements and class attendance.

2. Description of the Prior Art

Martial arts schools have provided valuable exercise, self-defense training and discipline to countless students that range in age from young children to the elderly. Most structured martial arts programs provide their students with several different tests and various tasks that must be accomplished in order to rise through the various skill levels. Currently, colored adhesive stripes are used to indicate the student's attendance, rank or achievements within the program. The stripes are typically made from pre-cut adhesive strips, or colored tape that is torn into strips, and wrapped around a portion of the student's belt, forming a transverse stripe across the belt. Unfortunately, these stripes are not reusable and often fall off of the belt, which causes problems with tracking the student's achievements.

In one prior art attempt to resolve the issue of the student losing one or more stripes, strips of material are used, having a heat-activated adhesive on their rearward surfaces. These strips are positioned along the belt and, with heat from an iron, are adhered to the belt. While this reduces the likelihood that a student will lose one or more stripes, the heat-activated adhesive is known to fail from time to time. These types of stripes also fail to address the issue of being able to effectively reuse the stripes. Moreover, these stripes can cost as much as $1.29 a piece, which can become costly. Most martial arts schools have a large number of students enrolled in various classes. Each student will presumably earn multiple achievement stripes for every level attained while attending the martial arts school. Over time, hundreds of students, each attaining numerous achievements, could generate a sizable expense for a martial arts school.

Most successful martial arts schools also attempt to keep an accurate attendance count for their classes. Most schools issue identification cards that are presented by the students upon their arrival at class. Unfortunately, ID cards are frequently damaged, disorganized, lost or forgotten at home. Equipment used to produce the ID cards requires the investment in equipment, such as a laminating machine, that has few if any other uses at the martial arts school. Keeping track of attendance through a role call and a manual tabulation becomes a drain on valuable class time and creates records that are not easily reviewed in the future.

Accordingly, what is needed is a new method and means for displaying and tracking martial arts achievements and attendance that simplifies the tracking of achievements and attendance of martial arts students, while reducing relative long-term costs.

SUMMARY OF THE INVENTION

The present invention provides a method and means for recording and displaying achievements on a martial arts belt. A base member is provided, having a forward face, a rearward face and a peripheral edge portion. A securement means is coupled with the base member that couples the base member with the martial arts belt. In one embodiment, the securement means is provided in the form of an arm member. The arm member may form a loop with the base member by attaching to opposite sides of the base member. The arm member may also have a freely disposed end that permits the base member to be coupled with or removed from a belt that is secured around an individual. Other securement means, including hook-and-loop fasteners and releasably engagable straps that extend outwardly from the base member, are also provided.

At least one achievement indicator is provided, having a forward face with indicator means for indicating a particular achievement. The indicator means may simply be comprised of a pre-determined color that represents a particular achievement. The indicator means may also be comprised of at least one pre-determined symbol, such as a design, letter, number or word representing a particular achievement.

Attachment means are provided for coupling the achievement indicator to the base member. In one embodiment, the achievement means is provided in the form of an adhesive or a hook-and-loop fastener disposed between the base and the achievement indicator. In another embodiment, a recess formed along the peripheral edge portion of base member receives at least a portion of the achievement indicator so that the achievement indicator is secured to the base member in plain view. Another embodiment provides a recess in the forward face of the base member. Arm members that extend outwardly from the achievement indicator are at least partially received within the recess formed within the forward face of the base member and the recess formed in the peripheral edge portion of the base member. In a preferred embodiment, the base member is designed to receive a plurality of achievement indicators.

Still another embodiment of the present invention provides graphical codes or symbols on the base member that are readable by an electronic scanner and stored within the database of a computer. Software is provided for storing and organizing the data collected by the scanner for attendance purposes. The software may also organize and track achievements attained by the individual students.

It is therefore a principle object of the present invention to provide a method for recording and displaying martial arts achievements that utilizes reusable components.

A further object of the present invention is to provide a method for recording and displaying martial arts achievements that utilizes components which are releasably engagable with a martial arts belt.

Still another object of the present invention is to provide a method for recording and displaying martial arts achievements that utilizes a belt clip that may releasably receive a plurality of individual achievement indicators that are independently recognizable for one or more particular achievements.

Yet another object of the present invention is to provide a method for recording and displaying martial arts achievements that serves to further assist in tracking a student's class attendance.

A further object of the present invention is to provide a method for recording and displaying martial arts achievements that is relatively simple and inexpensive to implement into a martial arts program.

Still another object of the present invention is to provide a method for tracking student attendance in a martial arts class that utilizes scanner technologies and a device worn by the student.

These and other objects of the present invention will be apparent to those having skill in the art.

DESCRIPTION OF THE PREFERRED EMBODIMENT

Figure 1:
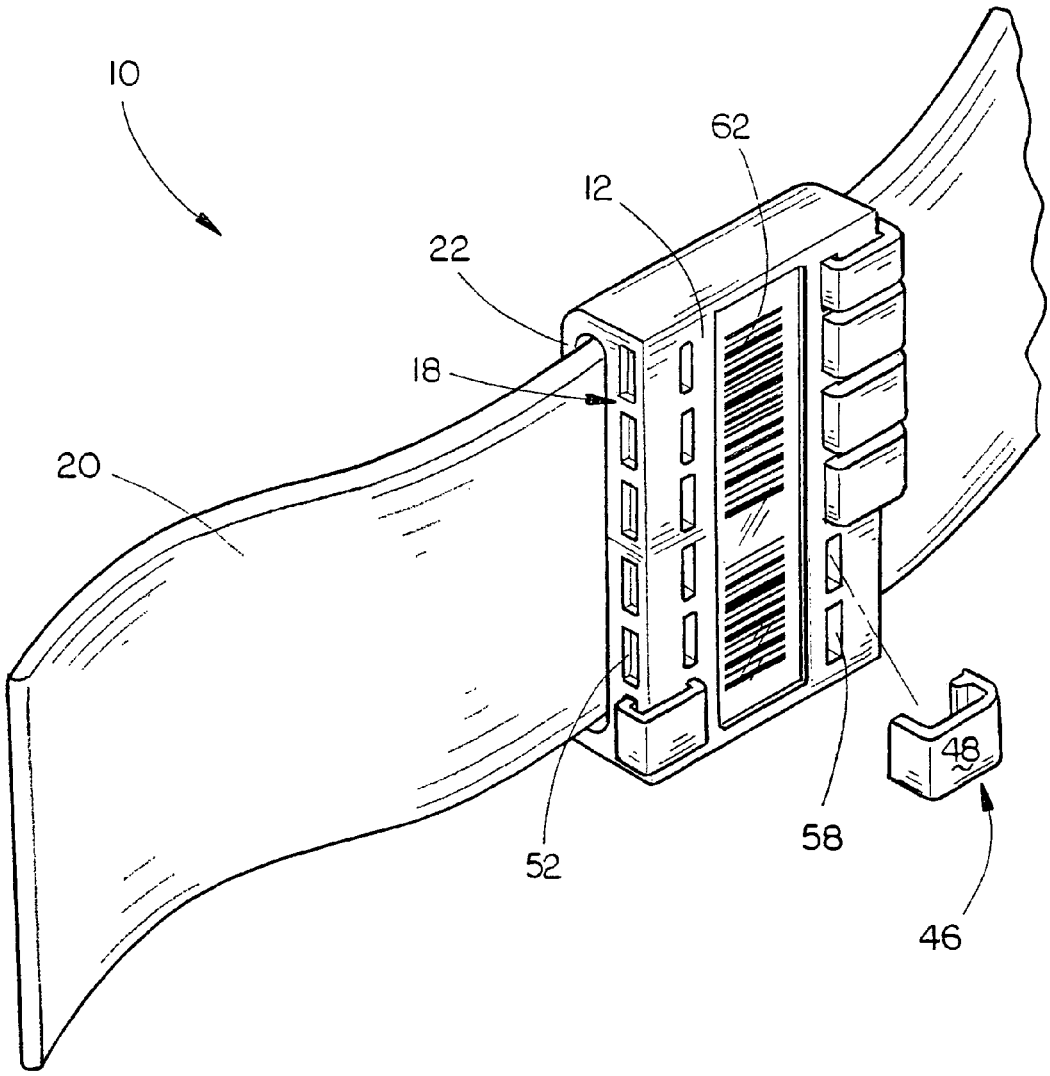
FIG. 1 is an isometric view of one embodiment of the achievement tracking system of the present invention as it may be coupled with a martial arts belt.
Figure 2:
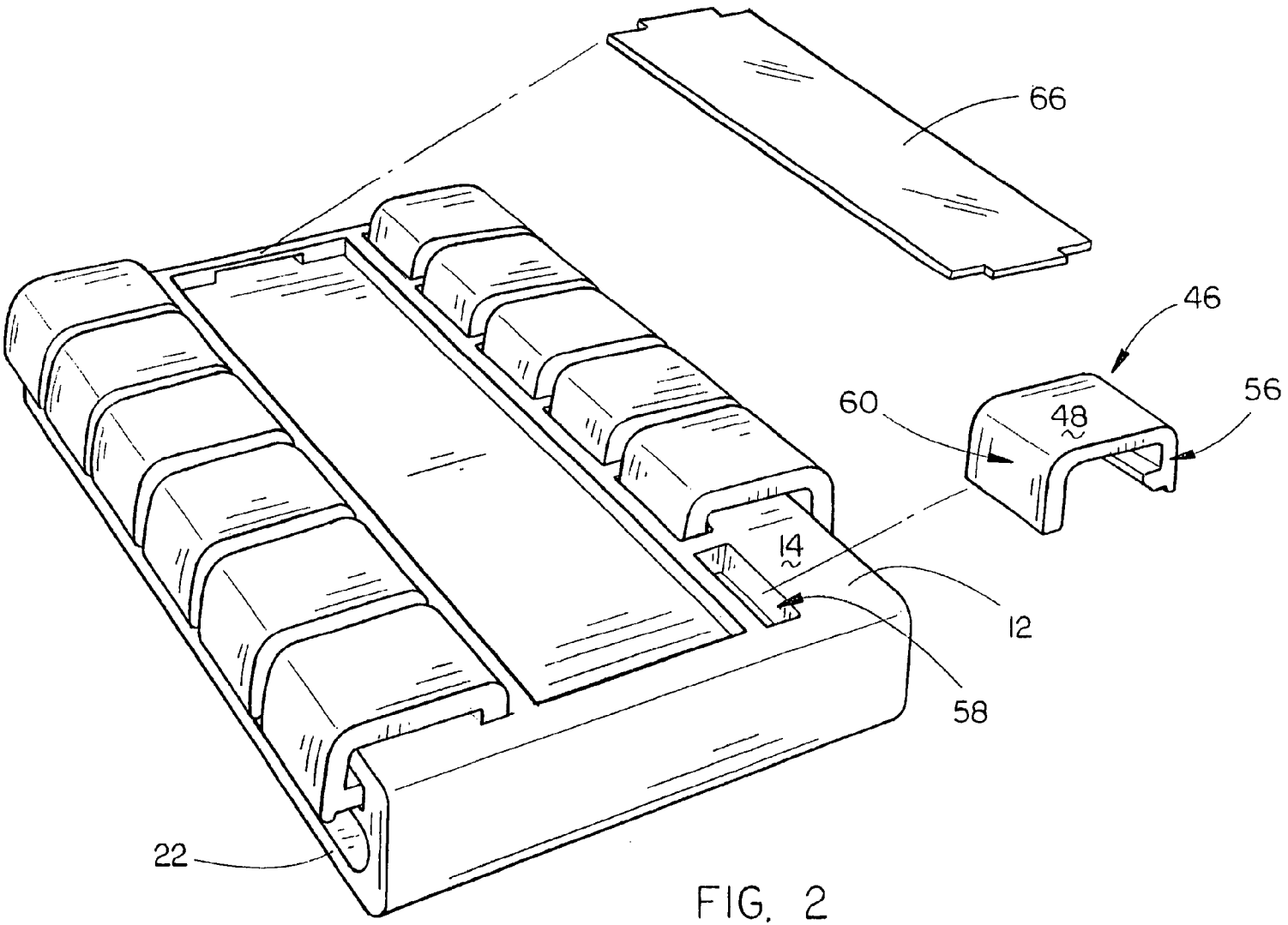
FIG. 2 is an isometric, partially disassembled view of the achievement tracking system depicted in FIG. 1.
Figure 3:
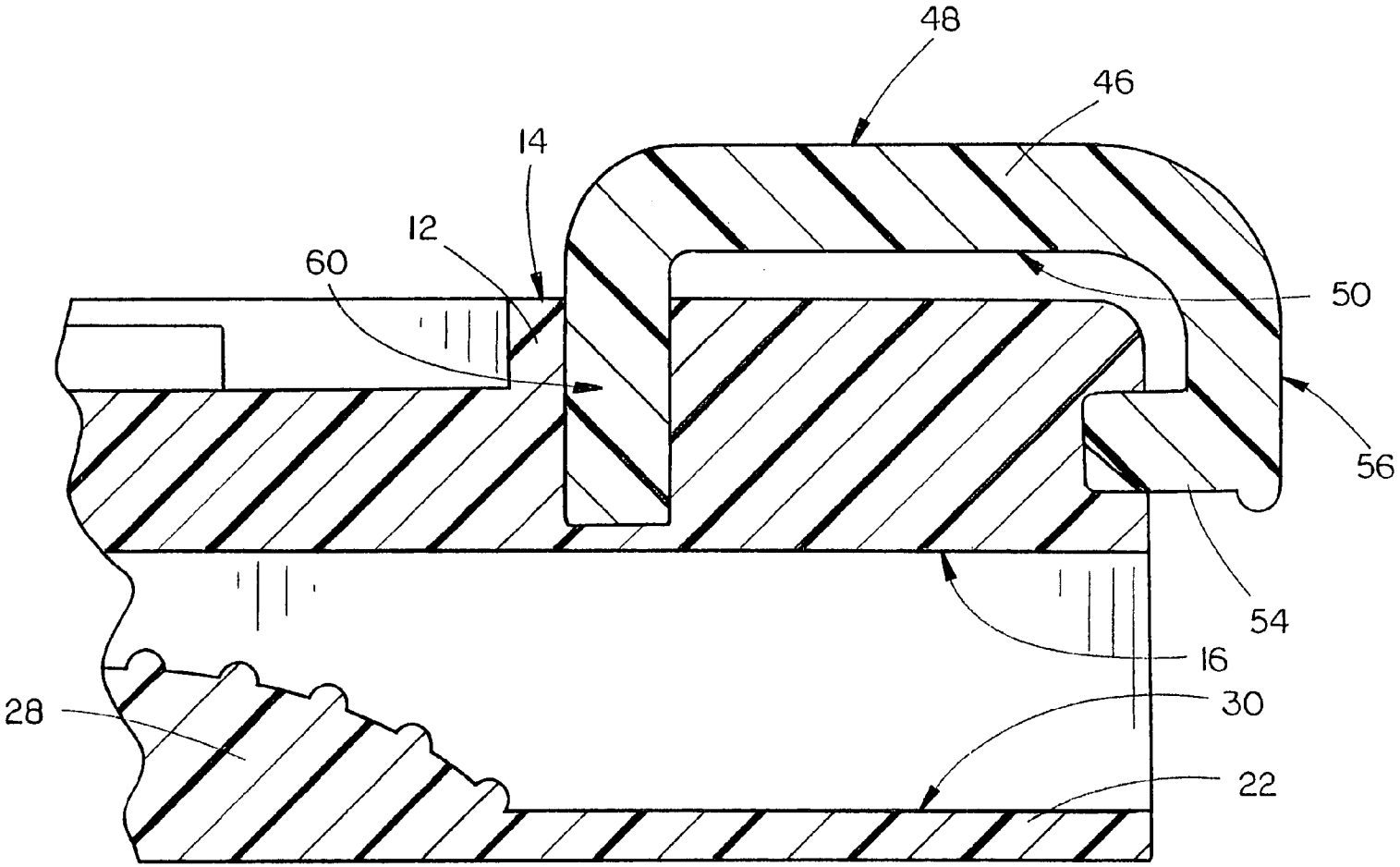
FIG. 3 is a partial, cutaway view of another embodiment of the achievement tracking system of the present invention.
Figure 4:
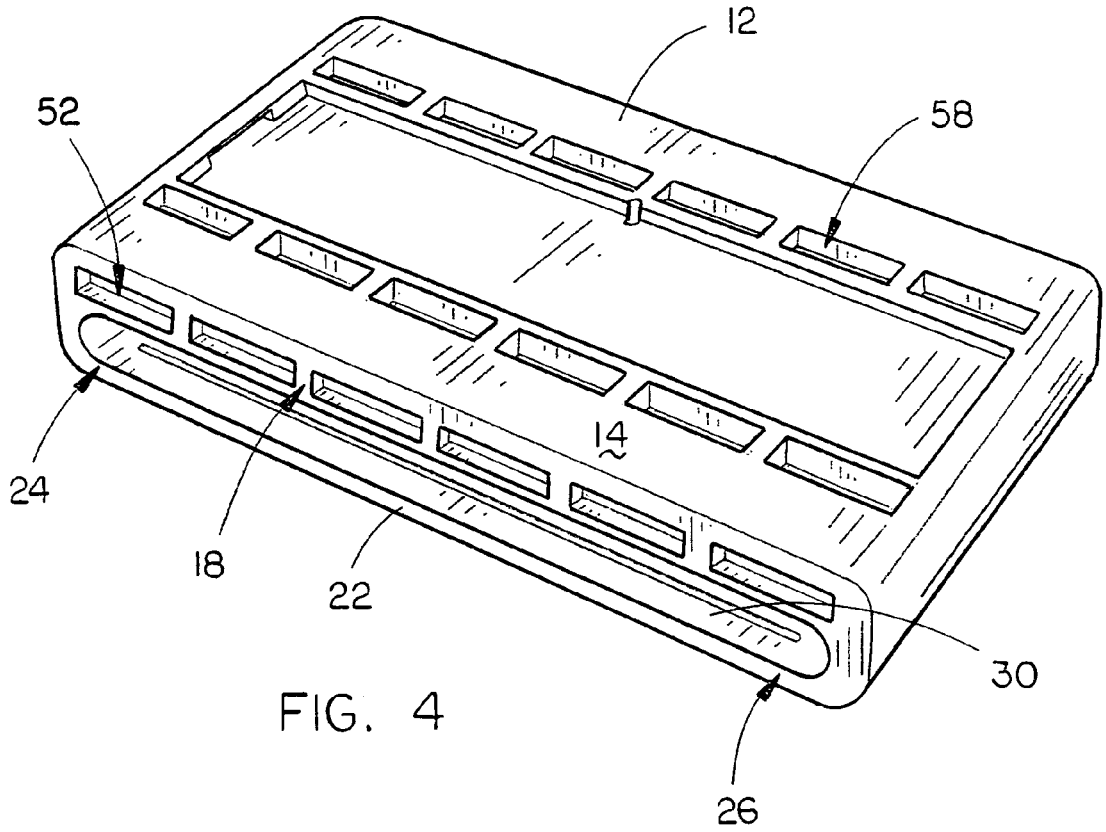
FIG. 4 is an isometric view of still another embodiment of the achievement tracking system of the present invention.
Figure 5:
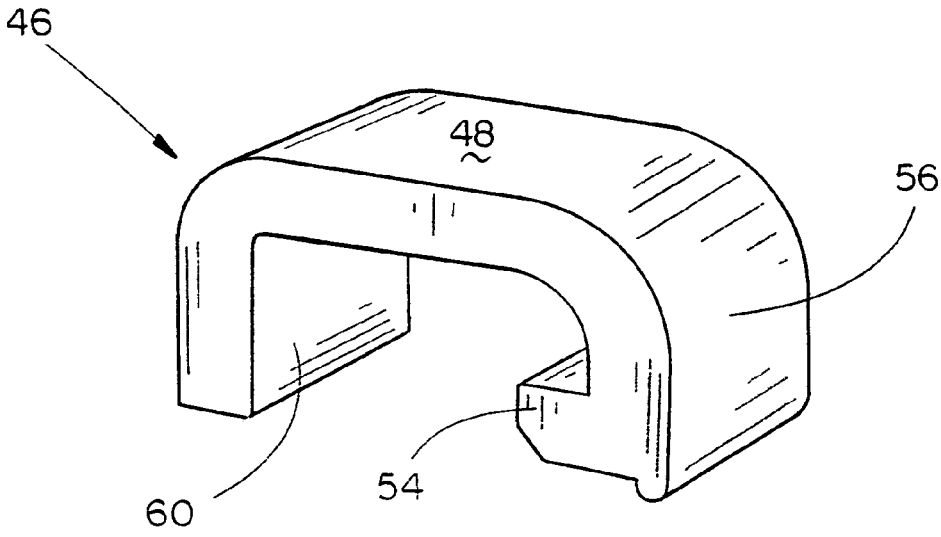
FIG. 5 is an isometric view of one embodiment of an achievement indicator that may be used as a part of the achievement tracking system of the present invention.
Figure 6:
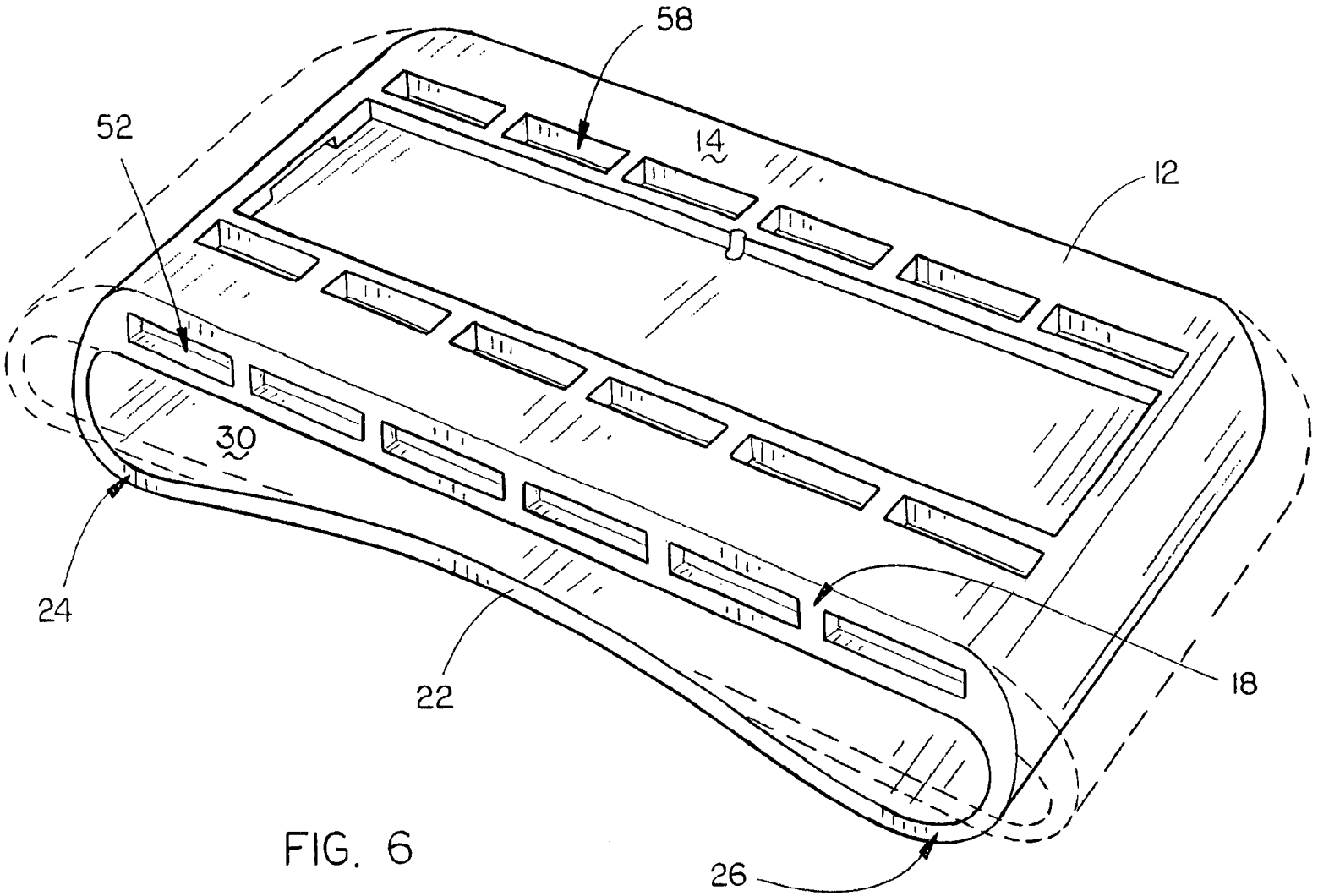
FIG. 6 is an isometric view of another embodiment of the achievement tracking system of the present invention that is formed from a deformably resilient material.
Figure 7:
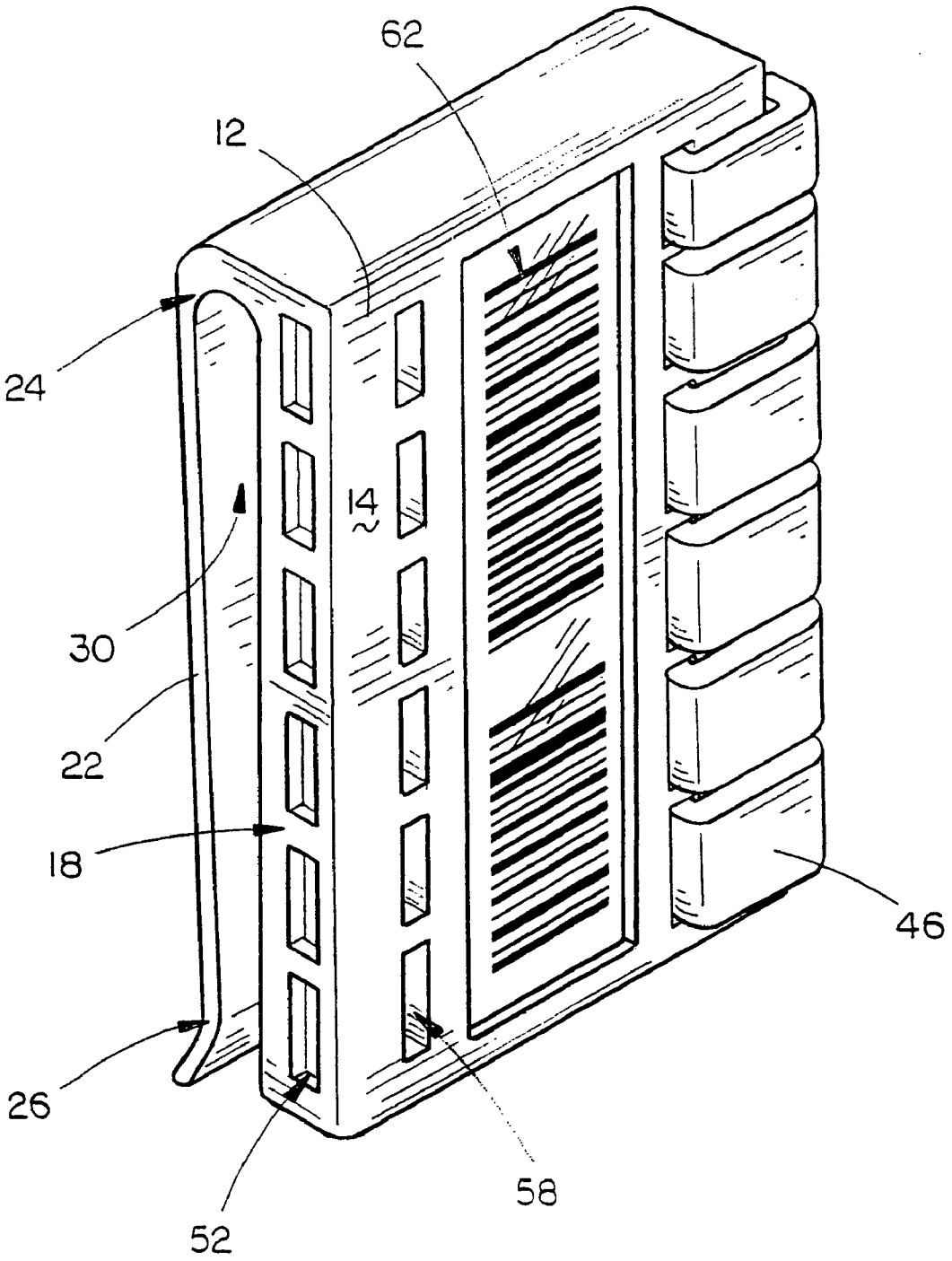
FIG. 7 is an isometric view of yet another embodiment of the achievement tracking system of the present invention, having a single, inwardly biased attachment arm.
Figure 8:
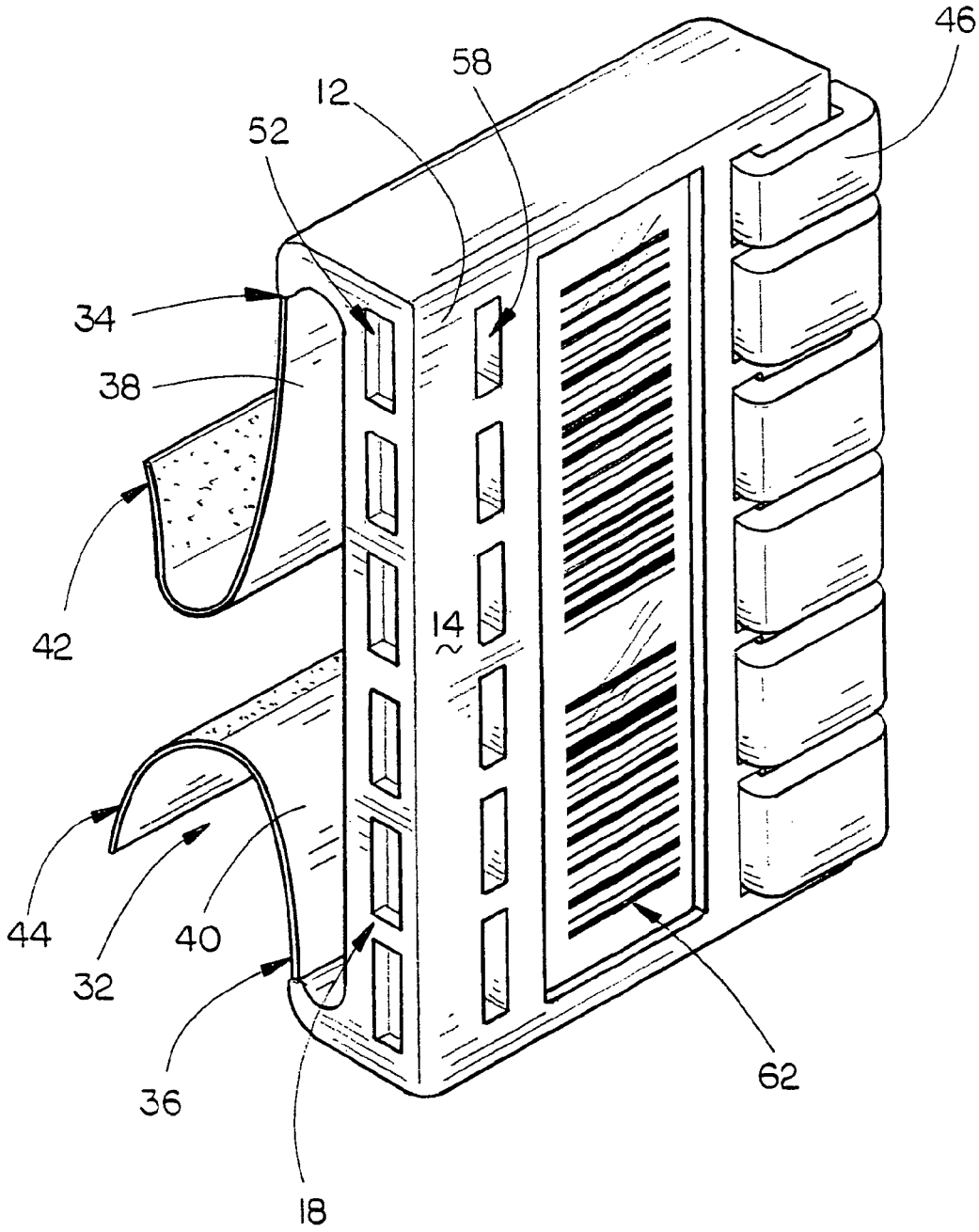
FIG. 8 is an isometric view of still another embodiment of the achievement tracking system of the present invention, having flexible attachment arms.

In the following detailed description of exemplary embodiments, reference is made to accompanying FIGS. 1-11, which form a part hereof and show, by way of illustration, exemplary embodiments of the present invention. These embodiments are disclosed in sufficient detail to enable those skilled in the art to practice the invention. It is to be understood that other embodiments may be utilized, however, and other changes may be made without departing from the spirit or scope of the present invention. The following detailed description is, therefore, not to be taken in a limiting sense in that the scope of the present invention is defined only by the appended claims.

The achievement tracking system 10 of the present invention is generally provided with a base member 12, having a forward face 14, a rearward face 16 and a peripheral edge portion 18. While the figures depict the base member 12 as being generally rectangular in shape, it is contemplated that the base member 12 could be provided in nearly any shape and size, without departing from the scope of the invention. Likewise the base member 12 could be constructed from several different materials, which may be flexible, semi-rigid, of rigid, depending upon the desired use. A securement means should be coupled with the base member 12 in a manner that permits the base member 12 to be operatively secured with a martial arts belt 20. While it is contemplated that the base member 12 could be permanently secured to the martial arts belt 20 using an adhesive, stitching or other mechanical fastener, a preferred embodiment provides a securement means that releasably couples the base member 12 with a martial arts belt 20. One such embodiment provides a mechanical fastener, such as a hook and loop style fastener to the base member 12 for securement with the martial arts belt 20.

In one embodiment, the securement means is comprised of an arm member 22, having a first end portion 24 and a second end portion 26. The arm member 22 is preferably positioned so that at least a portion of the arm member 22 extends along the rearward face 14 of the base member 12 in a spaced-relationship thereto. The space between the arm member 22 and the rearward face 16 of the base member 12 should be at least sufficient to permit a portion of the martial arts belt 20 to be received therein. In one embodiment, depicted in FIGS. 1, 2, 4 and 6, both the first end portion 24 and the second end portion 26 may be coupled with the base member 12, forming a loop through which the belt 20 may be passed. In another embodiment, depicted in FIG. 7, the second end portion 26 of the arm member 22 is left freely disposed in a spaced-relationship with the base member 12. In this embodiment, the base member 12 may be easily separated from the martial arts belt 20 by sliding the same in a vertical direction, transversely with the martial arts belt 20. Where such access is not necessary, the first and second end portions 24 and 26 are preferably left in contact with the base member 12 for an added element of security. In either embodiment, engagement between the base member 12 and the belt 20 may be made more secure by providing an engagement member 28 that extends outwardly from either a forward face 30 of the arm member 22 or the rearward face 16 of the base member 12. The engagement member 28 should be shaped and positioned to extend toward the opposing structure in such a manner that the engagement member 28 applies an added degree of pressure against a portion of the martial arts belt 20 when the martial arts belt 20 is positioned between the base member 12 and the arm member 22. In still another embodiment, depicted in FIGS. 6 and 7, the arm member 22 may be resiliently biased toward the rearward face 16 of the base 12 to apply a compression force to a portion of the martial arts belt 20. When desirable, it is also contemplated that the use of an engagement member 28 and a resiliently biased arm member 22 may be used in conjunction with one another.

Figure 9:
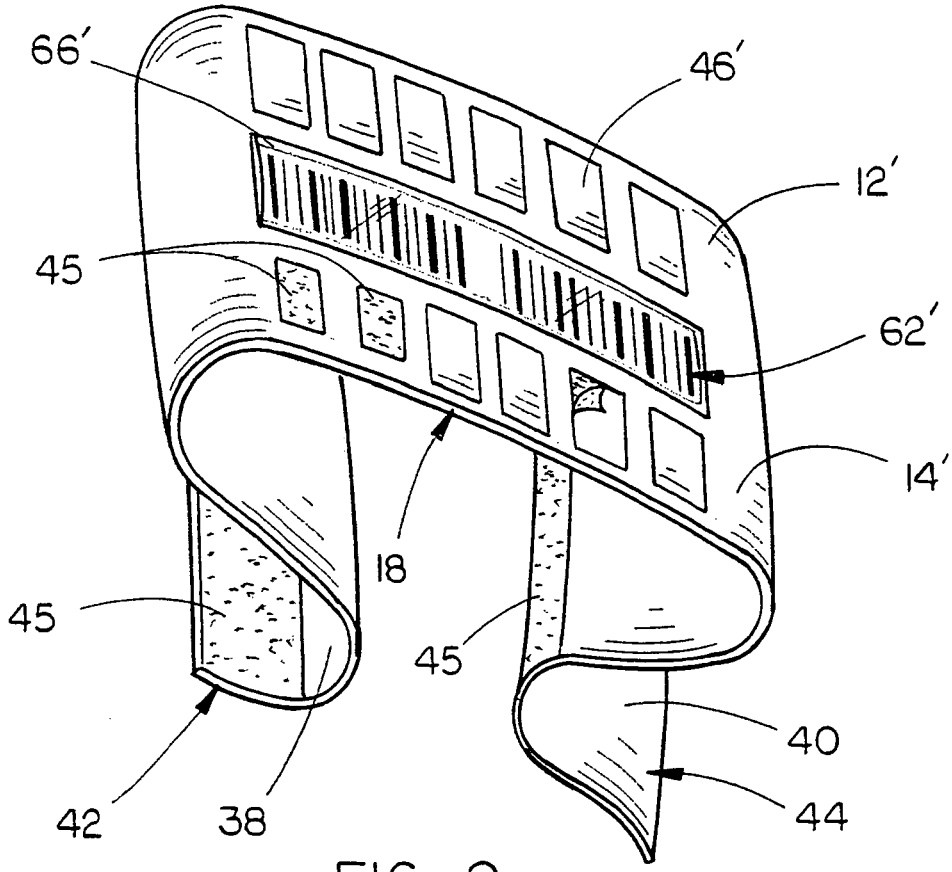
FIG. 9 is an isometric view of a further another embodiment of the achievement tracking system of the present invention, having a flexible base member and flexible attachment arms.
Figure 10:
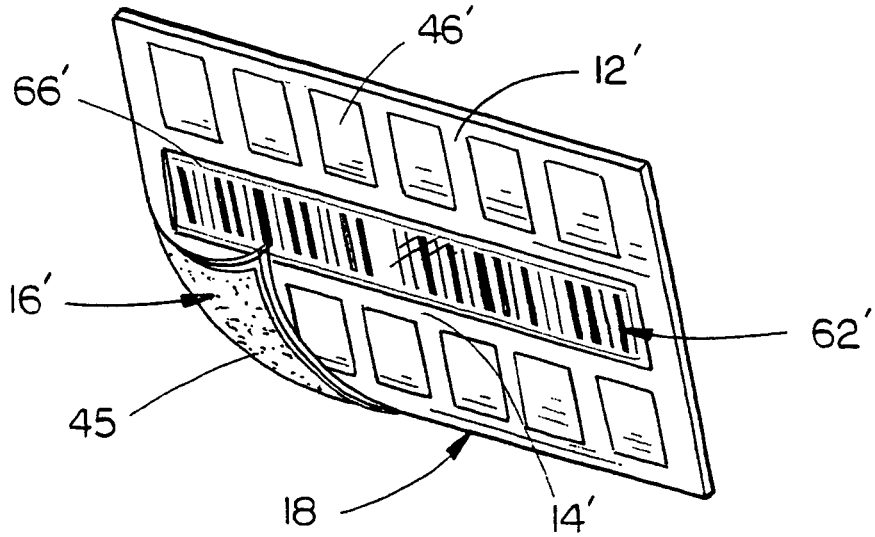
FIG. 10 is an isometric view of yet another embodiment of the achievement tracking system of the present invention, having a flexible base member and no attachment arms.
Figure 11:
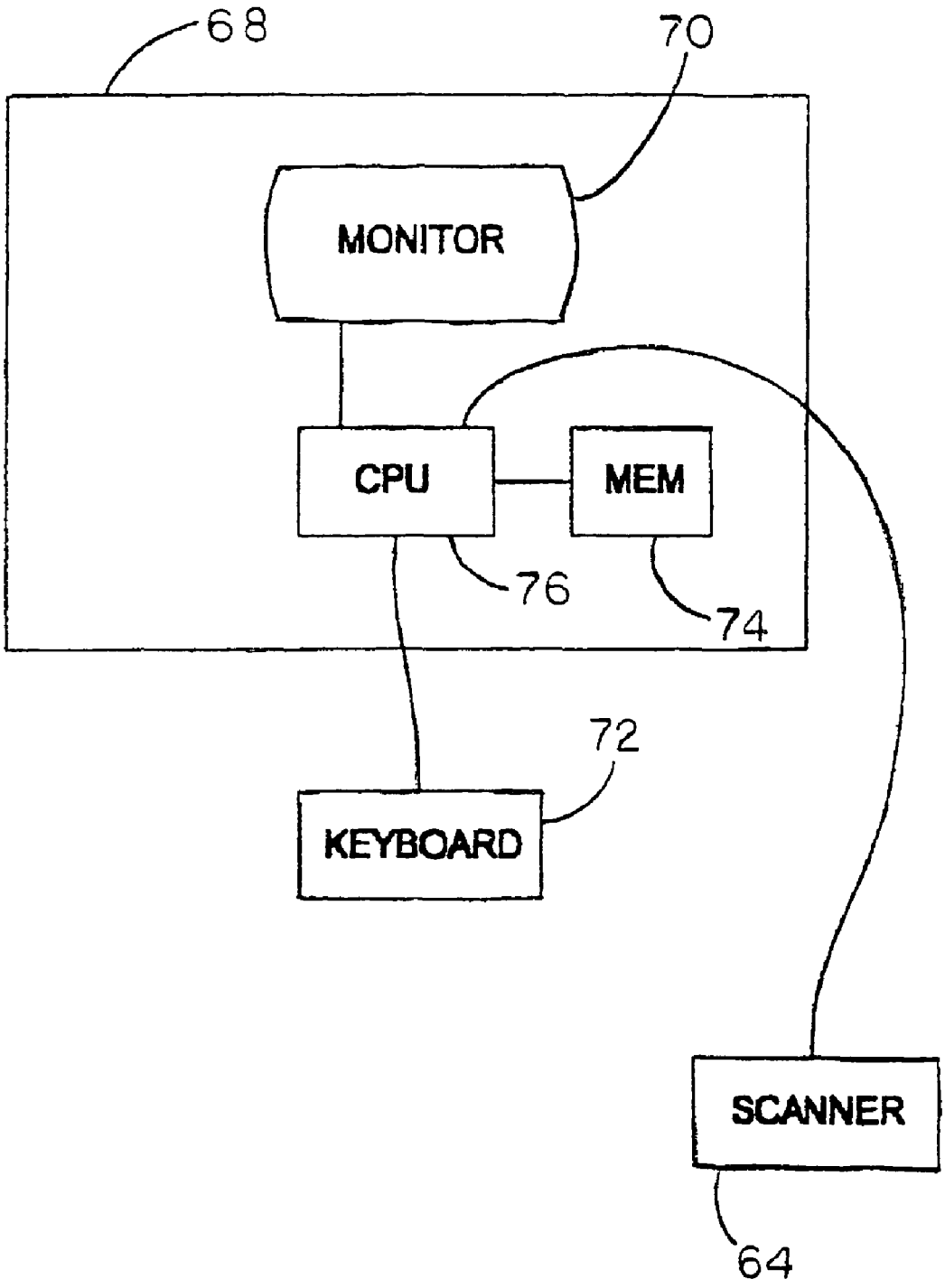
FIG. 11 is a system schematic of one embodiment of a computer and a scanner that may be used with the achievement tracking system of the present invention.

It is contemplated that the arm member 22, irrespective of its particular design, could be formed from either rigid or flexible materials. Accordingly, in one embodiment depicted in FIG. 8, the securement means may be provided with a flexible arm member 32 that is formed to be selectively separable, at a location between opposite end portions 34 and 36, to form a first sub-arm member 38 and a second sub-arm member 40. In such an embodiment, the first and second sub-arm members 38 and 40 should be selectively engagable with one another at opposing first and second inner end portions 42 and 44. Various mechanical fasteners, including hook-and-loop materials 45, snaps, buckles, hooks-and-eyes, and the like, are contemplated for securing the first and second sub-arm members 38 and 40 to one another. FIG. 9 depicts one embodiment where the base member 12', first sub-arm member 38, and second sub-arm member 40 are each comprised of a flexible material. Where a flexible material is chosen for either the base member 12', the arm member 22 or the flexible arm member 32, a flexible material that is generally elastic in nature may be selected in order to accommodate variations in belt sizes.

The achievement tracking system 10 should be provided with at least one achievement indicator 46, having a forward face 48 with an indicator means that denotes one of a plurality of different particular achievements. In one embodiment, the indicator means may simply be provided in the form of a particular color, wherein each individual achievement is paired with a particular color identifier. In another embodiment, however, the indicator means is comprised of at least one predetermined symbol that represents a particular achievement. For example, the symbol could take the form as a letter, a number, word or virtually any known or imagined shape or symbol. The type of indicator means selected should simply provide the users with easy identification of, and distinction between, various achievements.

The achievement indicators 46 may be attached to the base member 12 in several different manners. For example, various temporary adhesives may be employed. However, in a preferred embodiment depicted in FIGS. 9 and 10, a mechanical securement structure is used, which may take the form of a two-part hook-and-loop material 45, wherein one portion of the hook-and-loop material is coupled with a rearward surface 50 of the achievement indicator 46' and a second portion of the hook-and-loop material is coupled with the base member 12'. It is further contemplated that the attachment means could be provided in the form of a mechanical snap or hook-and-eye structure associated with the rearward surface 50 of the achievement indicator 46 and the base member 12. In one preferred embodiment, however, at least one side recess 52 is formed in the peripheral edge portion 18 of the base 12 that is shaped and sized to receive at least a portion of the achievement indicator 46. The side recess 52 could be sized and shaped to receive a substantial portion of the achievement indicator 46 in a secure position beneath the forward face 14 of the base member 12, where the forward face is formed from a generally transparent material. However, a preferred form of the side recess 52 is sized and shaped to receive a lip projection 54 that extends outwardly from a first arm member 56 that extends outwardly from the achievement indicator 46. Engagement between the achievement indicator 46 and the base member 12 may be improved by forming a top recess 58 in the forward face 14 of the base member 12. The top recess 58 should be shaped and sized to receive at least a portion of a second arm member 60 that extends outwardly from the achievement indicator 46. In this arrangement, it may be preferred to shape the achievement indicator 46, the first and second arm members 56 and 60 and position the side recess 52 and top recess 58 so that the first arm member 56 and second arm member 60 must be deflected slightly away from one another in order to become engaged within, or released from within, the side recess 52 and top recess 58. This will provide a simple manner of providing a secure engagement with the base member 12.

In another preferred embodiment, the achievement tracking system 10 may be used to track an individual's attendance to a series of classes or events. Various indicia 62, such as a bar code or a series of letters, numbers or characters may be disposed along a portion of the base member 12 that is accessible when the base member 12 is coupled with the martial arts belt 20. The indicia 62 is preferably selected from the type that are readable using an electric scanner 64. Accordingly, in a preferred embodiment, the indicia 62 is disposed on, or beneath a removable indicia plate 66 that is engagable with the base member 12. In another preferred embodiment, depicted in FIGS. 9 and 10, the indicia 62' may be disposed on a flexible material, such as paper or fabric, and disposed beneath or within a flexible, plate or pocket 66'.

A scanner 64 is provided in a hand-held, wall-mounted or desktop configuration. A decoder is provided and may be formed as a part of the scanner 64 or a computer 68 that is operatively coupled with the scanner 64. The computer 68 is preferably accompanied by a monitor 70, keyboard 72, a storage medium 74 such as a hard drive or removable diskette, and a processor 76. While the scanner 64, computer 68 and the associated components are depicted in FIG. 9 as being electrically wired with one another, wireless connections are contemplated. Software is provided to be operative on the processor 76 to receive electrical output from the scanner 64 and decoder and store the received data on the storage medium 74. The data may be displayed on the monitor 70 selectively and/or in a real-time fashion. The software may also be provided such that it may arrange and tabulate the data according to the user's needs. For example, entries can be made for each student within a martial arts class. Each student would be provided with a unique indicia 62 that is assigned to the student upon registration for the class. As each student enters the school, the indicia 62 may be scanned by the scanner 64. The software should operate on the computer 68 to compile the data according to each class and each student within each class. Accordingly, the database may be accessed by a user to determine the attendance of each student and identify the number of missed classes for a particular student, as well as the dates and times of each missed class.

The software could also be provided so that it could retain a database comprising entries for each achievement attained by the individual students. Accordingly, as a student reaches a particular achievement, the student may be provided with an achievement indicator 46 for use with the achievement tracking system 10 and an entry can be made on the computer 68 for the file assigned to that particular student and his or her indicia 62. This may provide an adequate backup recording system incase of loss or damage to the base member 12 and the achievement indicators 46 disposed thereon.

In the drawings and in the specification, there have been set forth preferred embodiments of the invention and although specific items are employed, these are used in a generic and descriptive sense only and not for purposes of limitation. Changes in the form and proportion of parts, as well as a substitution of equivalents, are contemplated as circumstances may suggest or render expedient without departing from the spirit or scope of the invention as further defined in the following claims.

Thus it can be seen that the invention accomplishes at least all of its stated objectives.

I claim:

1. A device for recording and displaying achievements on a martial arts belt, the device comprising:

a base member, having a forward face, a rearward face and a peripheral edge portion;

securement means coupled with said base member for operatively securing said base member with the martial arts belt;

at least one achievement indicator, having a forward face with indicator means for indicating a particular achievement;

attachment means for operatively attaching said at least one indicator to said base; and said attachment means being comprised of at least one side recess formed in the peripheral edge portion of said base that is shaped and sized to receive at least a portion of said at least one achievement indicator.

2. The device of claim 1 wherein said securement means is comprised of an arm member, having opposite end portions, that is positioned so that at least a portion of said arm member extends along the rearward face of said base in a spaced-relationship with said rearward face that permits a portion of the martial arts belt to be received between the rearward face of said base and said arm member.

3. The device of claim 2 wherein at least a portion of said arm member is resiliently biased toward the rearward face of said base.

4. The device of claim 2 wherein one of the end portions of said arm member is coupled with said base and the opposite end portion of said arm member is freely disposed in a spaced-relationship with said base.

5. The device of claim 2 wherein the opposite end portions of said arm member are operatively coupled to said base member.

6. The device of claim 5 further comprising an engagement member that extends outwardly from a forward face of said arm member toward the rearward face of said base such that said engagement member applies pressure against a portion of the martial arts belt when a portion of the martial arts belt is positioned between said arm member and said base.

7. The device of claim 5 wherein said arm member is comprised of a flexible material.

8. The device of claim 7 wherein said flexible material is elastic in nature.

9. The device of claim 7 wherein said arm member is formed to be selectively separable, at a location between the opposite end portions of said arm member, to form a pair of selectively engagable sub-arm members.

10. The device of claim 1 wherein said securement means is comprised of a two-part, hook-and-loop fastener, wherein one part of said hook-and-loop fastener is operatively coupled with the rearward face of said base and a second part of said hook-and-loop fastener is operatively coupled with said martial arts belt.

11. The device of claim 1 wherein said indicator means is comprised of at least one pre-determined color that represents a particular achievement.

12. The device of claim 1 wherein said indicator means is comprised of at least one pre-determined symbol that represents a particular achievement.

13. The device of claim 1 wherein said attachments means is further comprised of at least one top recess formed in the forward face of said base that is shaped and sized to receive at least a portion of said at least one achievement indicators.

14. The device of claim 13 wherein said attachment means is further comprised of first and second indicator arm members that extend outwardly from said at least one achievement indicator; said first indicator arm member being shaped and sized to be at least partially received within said at least one side recess and said second indicator arm being shaped and sized to be at least partially received within said at least one top recess.

15. The device of claim 1 further comprising indicia, which is unique to and identifies a particular individual, disposed along a portion of the device; said indicia being of a type that is readable by an electric scanner and identified by a decoder operatively coupled with said scanner.

16. The device of claim 1 wherein said indicia that is readable by an electric scanner and identified by a decoder operatively coupled with said scanner associates said individual with attendance data for said individual at an event attended by said individual.

17. The device of claim 1 wherein said indicia that is readable by an electric scanner and identified by a decoder operatively coupled with said scanner associates said individual with an achievement by said individual in the form of achievement data.

* * * * *